US007306498B2

(12) United States Patent
Inoue

(10) Patent No.: US 7,306,498 B2
(45) Date of Patent: Dec. 11, 2007

(54) OUTBOARD MOTOR HAVING AIR SUCTION DEVICE

(75) Inventor: Toshiyuki Inoue, Shizuoka (JP)

(73) Assignee: Yamato Giken Kabushiki Kaisha, Shizuoka (JP)

( * ) Notice: Subject to any disclaimer, the term of this patent is extended or adjusted under 35 U.S.C. 154(b) by 20 days.

(21) Appl. No.: 11/259,319

(22) Filed: Oct. 26, 2005

(65) Prior Publication Data

US 2007/0021016 A1 Jan. 25, 2007

(30) Foreign Application Priority Data

Jul. 20, 2005 (JP) ..... 2005-209839

(51) Int. Cl.
*B63H 21/36* (2006.01)
*B63H 21/38* (2006.01)

(52) U.S. Cl. ..... 440/77; 440/88 A; 123/198 E

(58) Field of Classification Search ..... 123/198 E; 440/77, 88 A, 99 R
See application file for complete search history.

(56) References Cited

U.S. PATENT DOCUMENTS 6,716,263 B2 * 4/2004 Inoue et al. ..... 55/385.1
6,821,170 B2 * 11/2004 Sanschagrin et al. ..... 440/77
2001/0019927 A1 * 9/2001 Tawa et al. ..... 440/88

FOREIGN PATENT DOCUMENTS

JP 2002195118 A 7/2002
JP 2002227732 A 8/2002

* cited by examiner

*Primary Examiner*—Sherman Basinger
(74) *Attorney, Agent, or Firm*—Patterson, Thuente, Skaar & Christensen, P.A.

(57) ABSTRACT

An outboard motor having an air suction device comprising a main part having an engine, a top cover mounted on a top portion of the main part, the top cover being composed of a main cover having an air space surrounding an outer surface of the engine and of an auxiliary cover which is provided on the main cover so as to cover the main cover and to form an air suction room therein, an opening provided on the main cover so as to communicate between the air space in the main cover and the air suction room in the auxiliary cover, an air suction port provided on the auxiliary cover so as to communicate the air suction room in the auxiliary cover to atmosphere, and a water proof sheet mounted in the auxiliary cover in order to cover the opening.

1 Claim, 4 Drawing Sheets

PRIOR ART FIG. 8

OUTBOARD MOTOR HAVING AIR SUCTION DEVICE

RELATED APPLICATION

The present application claims priority to Japanese Application No. 209839/2005 filed Jul. 20, 2005.

BACKGROUND OF THE INVENTION

1. Field of the Invention

The present invention relates to an outboard motor having an air suction device, and more particularly, relates to an outboard motor having a water proof air suction device, wherein water droplets splashed by a screw of the outboard motor is prevented from entering into an air to be introduced into an engine installed in a top cover of the outboard motor.

2. Description of the Prior Art

A conventional outboard motor is normally composed of a main part having therein a driving mechanism and supporting a screw at a lower portion thereof, an engine mounted on an upper portion of the main part and connected to the driving mechanism, and a top cover of synthetic resin covering an outer surface of the engine. Specifically, as shown in FIG. 8, an air suction port 24 is provided at a rearward upper portion of a top cover 20 so as to introduce an atmosphere into an air space 20*d* formed between the top cover 20 and an engine 18 and to deliver the atmosphere into engine cylinders through air suction pipes 18*d* arranged in the air space 20*d* and connected to an air suction box 18*c* common to the engine cylinders, respectively.

The atmosphere introduced through the air suction port 24 includes water droplets splashed by a screw of the outboard motor. Accordingly, the water droplets are removed in a labyrinth in an air suction room 25 formed between the air suction port 24 and the air space 20*d* by using a difference in specific gravity of the air and water. Specifically, the atmosphere to be introduced into the engine 18 is commutated in the air suction room 25 and then introduced into the air space 20*d* formed in the top cover 20 through an opening 22, as shown in the Japanese Patent Application Laid-Open No. 195118/2002, for example.

However, it is difficult to remove fully the water droplets by the conventional simple water droplets removing device, because recently the engine becomes large in power and the suction air quantity becomes large. Accordingly, it has been proposed by the present inventor to use a water proof sheet for preventing the sea water from invading into the engine of the small surface boat, even if the boat is turned over, as shown in the Japanese Patent Application Laid-Open No. 227732/2002, for example.

However, it is difficult to arrange the water proof sheet in the top cover 20 and to discharge suitably the water removed by the water proof sheet to the outside of the top cover 20, because the top cover 20 is formed by thermosetting in the metal mold a thin sheet-like synthetic resin, or a so-called SMC method.

Further, the structure of the top cover becomes complicated so that it is difficult to form by the SMC method, if an air space for the water proof sheet is provided independent of the inside of the top cover, or a passage for discharging the water removed by the water proof sheet to the outside of the top cover is provided.

SUMMARY OF THE INVENTION

Accordingly, it is an object of this invention to provide an outboard motor comprising a main part having an engine, a top cover mounted on a top portion of the main part, the top cover being composed of a main cover having an air space surrounding an outer surface of the engine and of an auxiliary cover which is provided on the main cover so as to cover the main cover and to form an air suction room therein, an opening provided on the main cover so as to communicate between the air space in the main cover and the air suction room in the auxiliary cover, an air suction port provided on the auxiliary cover so as to communicate the air suction room in the auxiliary cover to atmosphere, and a water proof sheet mounted in the auxiliary cover in order to cover the opening.

Another object of the present invention is to provide an outboard motor, wherein the auxiliary cover is provided on the main cover detachably.

A further object of the present invention is to provide an outboard motor, wherein the water proof sheet consists of an unwoven fabric processed so as to have a water repellency.

Yet further object of the present invention is to provide an outboard motor wherein the upper surface of the main cover is inclined downwards in the backward direction when the main part is attached to a boat, so that water droplets attached to the upper surface of the main cover are flowed along the inclined upper surface of the main cover.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

FIG. 8 is a side view of a conventional outboard motor with a portion being removed.

DESCRIPTION OF THE PREFERRED EMBODIMENTS

Figure 1:
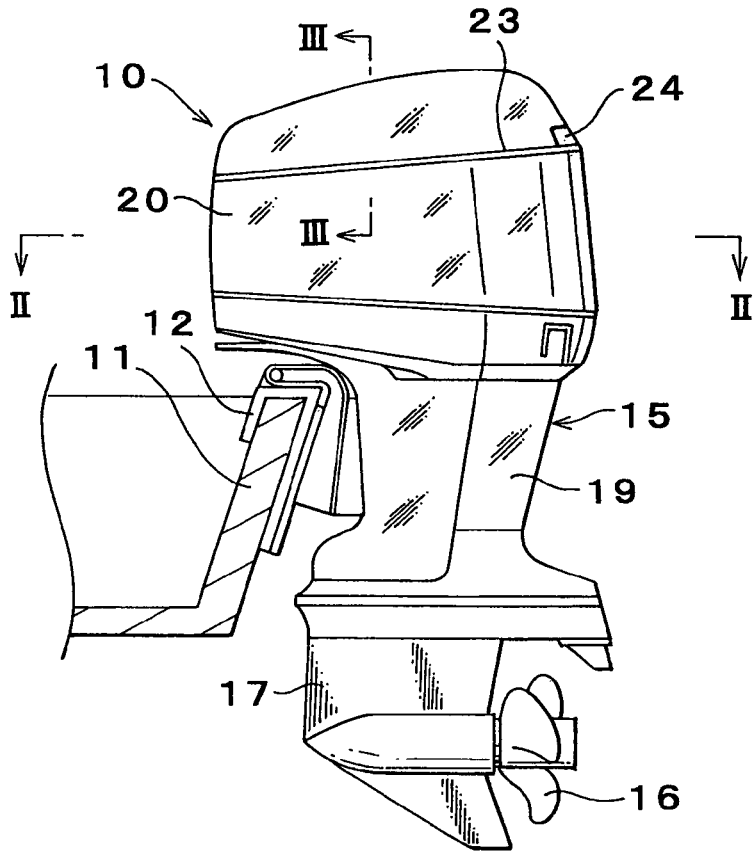
FIG. 1 is a side view of an outboard motor having an air suction device of the present invention.

FIG. 1 shows an outboard motor 10 using an air suction device according to the present invention. The outboard motor 10 comprises a clamp portion 12 to be connected to a stem frame 11 of a boat, and a main part 15 to be connected to the clamp portion 12 so as to allow swaying.

Figure 2:
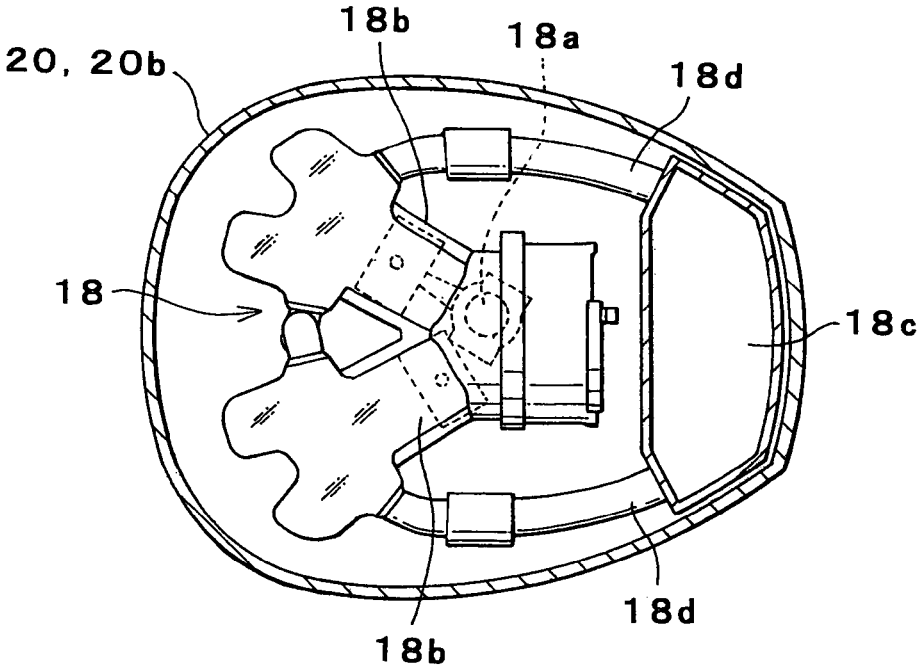
FIG. 2 is an enlarged sectional view of the outboard motor taken along the line II-II of FIG. 1.

The main part 15 comprises a lower propelling portion 17 having a screw 16, an upper portion having an engine 18 covered with a top cover 20, and an intermediate driving portion 19 for connecting the engine 18 to the propelling portion 17. As shown in FIG. 2, the engine 18 covered with the top cover 20 comprises a vertical crank shaft 18*a*, cylinders 18*b*, 18*b* arranged along a figure of V, an air suction box 18*c*, and air suction pipes 18*d*, 18*d*, upstream ends of the air suction pipes 18*d*, 18*d* being connected to the air suction box 18*c* and downstream ends of the air suction pipes 18*d*, 18*d* being connected to the cylinders 18*b*, 18*b*, respectively, so that the atmosphere introduced into the air suction box 18*c* is sucked into the cylinders 18*b*, 18*b* through the air suction pipes 18*d*, 18*d*, respectively.

Figure 3:
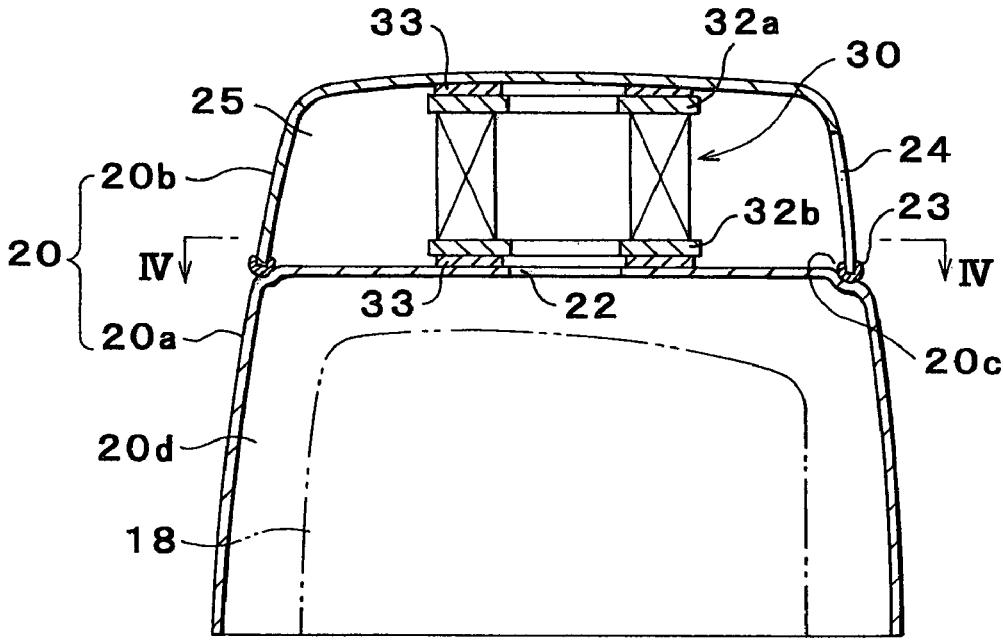
FIG. 3 is an enlarged sectional view of the outboard motor taken along the line III-III of FIG. 1.
Figure 4:
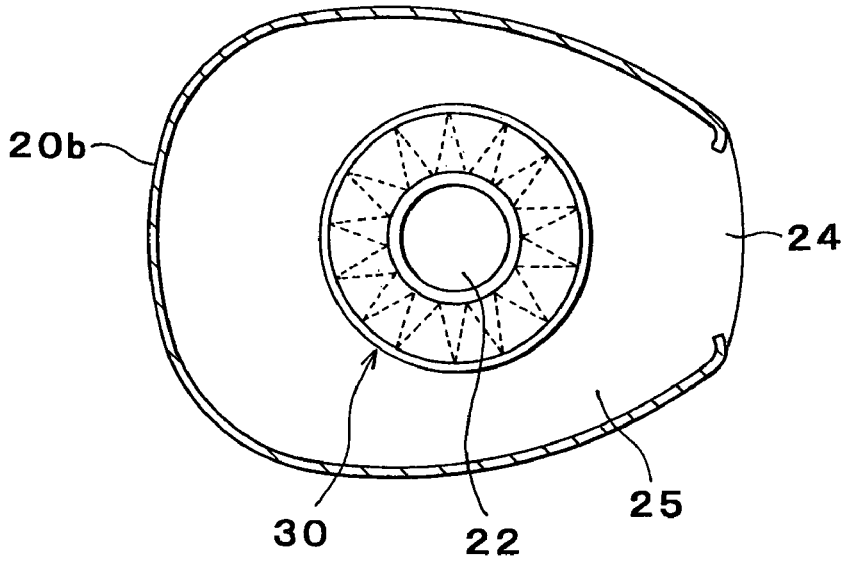
FIG. 4 is an enlarged sectional view of the outboard motor taken along the line IV-IV of FIG. 3.

It is apparent from FIG. 3, that the top cover 20 comprises a main cover 20*a* having an air space 20*d* surrounding the upper and side surfaces of the engine 18 therein and an opening 22 formed on the top plate thereof, and an auxiliary cover 20*b* mounted detachably on the main cover 20*a* so as to cover the upper surface of the main cover 20*a* and to form an air suction room 25 in the auxiliary cover 20*b*.

The top plate of the main cover 20*a* serves as a partition wall for separating the air space 20*d* in the main cover 20*a* and the air suction room 25 in the auxiliary cover 20*b*. The air suction room 25 is communicated with atmosphere through an air suction port 24 provided at a rearward upper potion of the top cover 20.

As shown in FIG. 3, the main cover 20*a* covers the upper and side surfaces of the engine 18, and the upper surface of the main cover 20*a* is flat, but is inclined slowly downwards in the backward direction of the outboard motor 10 when the main part 15 is attached to the boat, so that the water droplets attached to the upper surface of the main cover 20*a* are flowed along the inclined upper surface of the main cover 20*a* and discharged outside. The lower edge portion of the auxiliary cover 20*b* is supported by the marginal portion of the main cover 20*a* through a rubber seal 23 fitted into a groove 20*c* formed on the marginal portion of the main cover 20*a*.

The auxiliary cover 20*b* is formed of a cylinder having an upper plate, a lower opening, and the air suction port 24 formed in the back side wall thereof. The air suction room 25 is formed between the main cover 20*a* and the auxiliary cover 20*b*, and the atmosphere can be introduced into the air suction room 25 through the air suction port 24.

Figure 7:
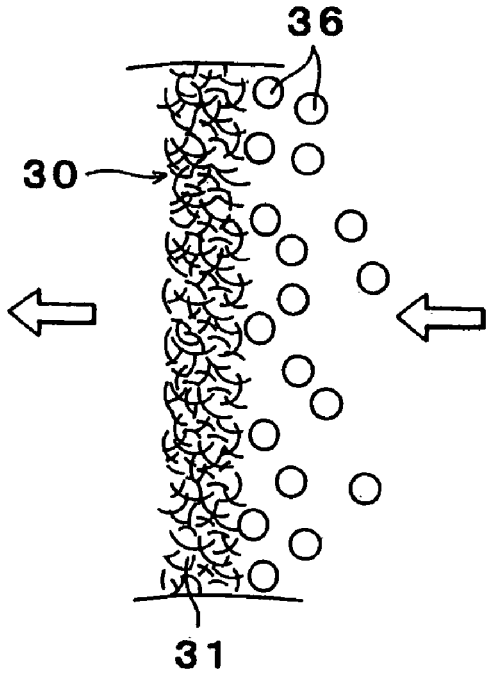
FIG. 7 is an enlarged sectional view for explaining the essential portion of a water proof sheet.
Figure 7:
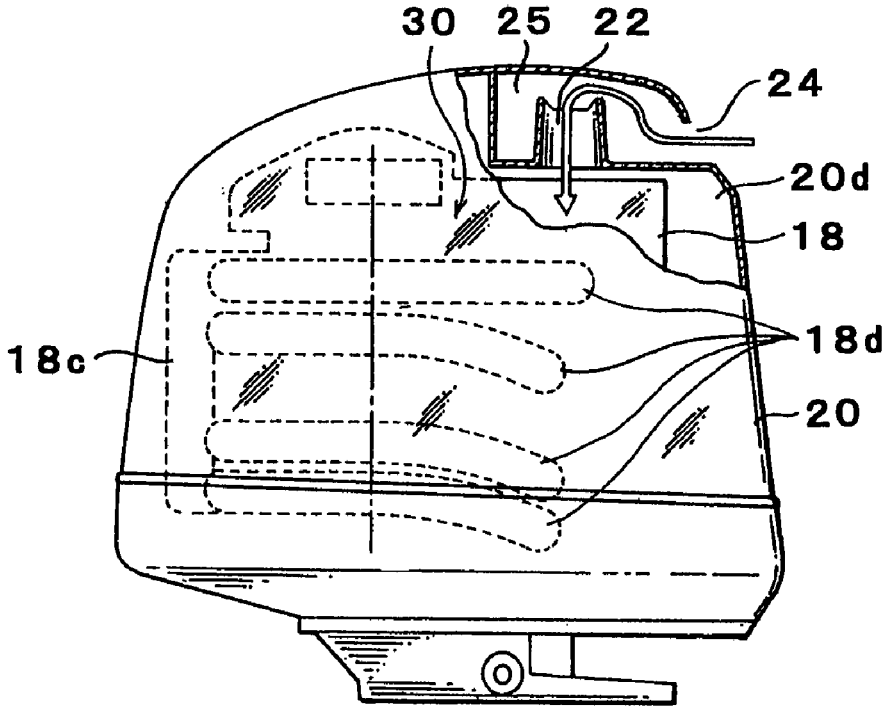

A waterproof sheet 30 is provided in the air suction room 25 so as to cover the opening 22. As shown in FIG. 7, the waterproof sheet 30 consists of a thin air permeable unwoven fabric 31 of 0.5 to 1 mm in thickness, the surface of each thread of the fabric 31 being processed so as to have a water repellency. The unwoven fabric 31 having a clearance between the threads of the fabric smaller than the diameter of the water molecular is selected.

The waterproof sheet 30 is formed by folding ninety-nine times an elongated thin unwoven fabric, connecting both ends thereof as an endless state, and inserting it between an upper supporting plate 32*a* and a lower supporting plate 32*b* to adhere thereto, as shown in FIG. 3. The waterproof sheet 30 constructed as mentioned above is a small in size, and has a large air permeable area and a small air-flow resistance. The air space 20*d* in the main cover 20*a* is separated air tightly from the air suction room 25 in the auxiliary cover 20*b* by rubber packings 33.

Figure 5:
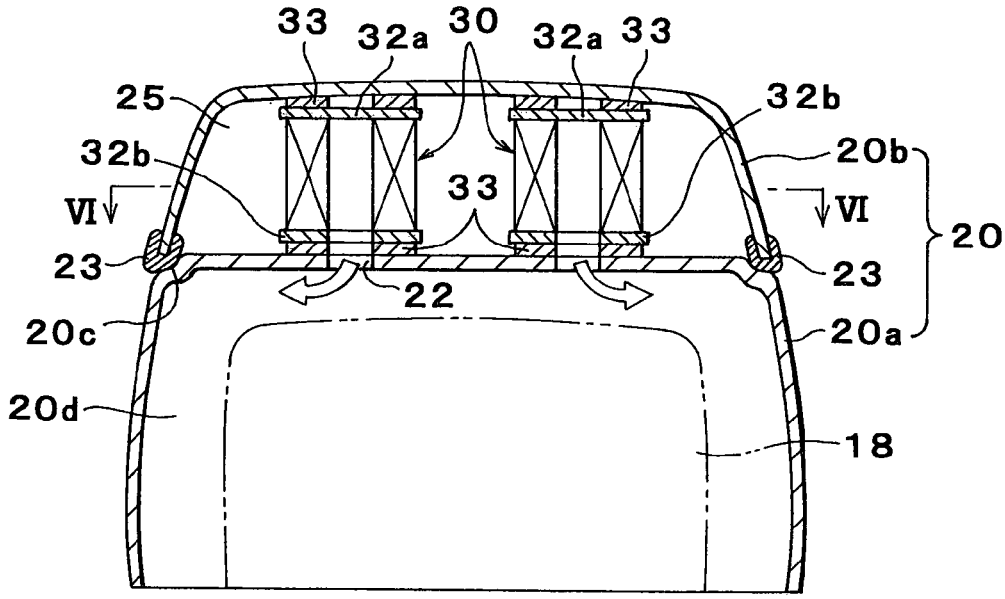
FIG. 5 is a sectional view of an upper part of the outboard motor of the other embodiment of the present invention.
Figure 6:
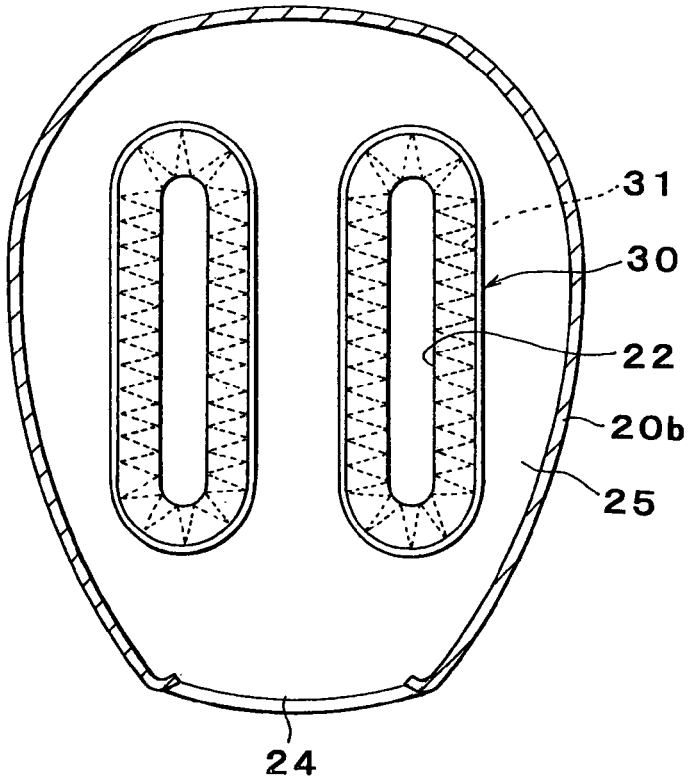
FIG. 6 is a sectional view of the outboard motor taken along the line VI-VI of FIG. 5.

As shown in FIG. 5 and FIG. 6, in the other embodiment of the present invention, two waterproof sheets 30 are provided, if the air permeable area is insufficient.

According to the outboard motor using the air suction device of the present invention, a negative pressure in the engine is applied to the air suction room 25 through the air suction pipes 18*d* and the air suction box 18*c*, so that the atmosphere is sucked through the air suction port 24 when the engine 18 is started. Even if the water droplets are included into the atmosphere, the water droplets are prevented from passing through the opening 22 by the waterproof sheet 30, and the water droplets are flowed to the inclined upper surface of the main cover 20*a* along the waterproof sheet 30 and the lower supporting plate 32*b*, and then removed to the outside through the air suction port 24.

In the outboard motor having the air suction device according to the present invention, the air suction room 25 opened the atmosphere can easily be provided, because the top cover 20 is formed by the main cover 20*a* having the lower opening and the auxiliary cover 20*b* having the air suction port 24. Further, water droplets separated from the air in the air suction room 25 are flowed to the outside by the gravity along the inclined upper surface of the main cover 20*a* against the current of the introduced air. The water droplets included in the air introduced into the air suction room 25 in the auxiliary cover 20*b* through the air suction port 24 are removed by the waterproof sheet 30, so that the air having no water droplets can be introduced into the engine 18 through the air space 20*d* in the main cover 20*a*, so that the outer surface of the engine is prevented from being corroded by the water and the durability of the engine can be increased.

The assembly of the waterproof sheet 30 can easily be carried out effectively by merely removing the auxiliary cover 20*b* from the main cover 20*a*, because the waterproof sheet 30 is held between the main cover 20*a* and the auxiliary cover 20*b*. Further, it is not necessary to vary the appearance of the top cover due to the air suction room 25 having the waterproof sheet 30, so that the sense in design is not spoiled.

While the invention has been particularly shown and described with reference to the preferred embodiments thereof, it will be understood by those skilled in the art that various changes in form and details may be made therein without departing from the spirit and scope of the invention as defined by the appended claims.

I claim:

1. An outboard motor having an air suction device comprising a main part having an engine, a top cover mounted on a top portion of the main part, the top cover being composed of a main cover having an air space surrounding an outer surface of the engine and of an auxiliary cover which is provided detachably on the main cover so as to cover the main cover and to form an air suction room therein, an opening being provided on a top portion of the main cover so as to communicate between the air space in the main cover and the air suction room in the auxiliary cover, an air suction port provided on the auxiliary cover so as to communicate the air suction room in the auxiliary cover to atmosphere, and a water proof sheet consisting of an unwoven fabric processed so as to have a water repellency, mounted in the auxiliary cover in order to cover the opening, wherein an upper surface of the main cover is inclined downwards in a backward direction when the main part is attached to a boat, so that water droplets attached to the upper surface of the main cover are flowed down along the inclined upper surface of the main cover and discharged through the air suction port.

* * * * *